US010030488B2

(12) United States Patent
Lemetayer et al.

(10) Patent No.: US 10,030,488 B2
(45) Date of Patent: Jul. 24, 2018

(54) HYDROCARBON PRODUCTION FACILITY, PRODUCTION METHOD AND UPGRADE METHOD

(71) Applicant: TOTAL SA, Courbevoie (FR)

(72) Inventors: Pierre Lemetayer, Pau (FR); Jean-Louis Beauquin, Saint-Faust (FR); Mark Banman, Calgary (CA)

(73) Assignee: Total SA, Courbevoie (FR)

( * ) Notice: Subject to any disclaimer, the term of this patent is extended or adjusted under 35 U.S.C. 154(b) by 141 days.

(21) Appl. No.: 15/029,172

(22) PCT Filed: Oct. 14, 2014

(86) PCT No.: PCT/EP2014/072006
§ 371 (c)(1),
(2) Date: Apr. 13, 2016

(87) PCT Pub. No.: WO2015/055645
PCT Pub. Date: Apr. 23, 2015

(65) Prior Publication Data

US 2016/0258262 A1 Sep. 8, 2016

(30) Foreign Application Priority Data

Oct. 14, 2013 (FR) ..... 13 59993

(51) Int. Cl.
*E21B 43/12* (2006.01)

(52) U.S. Cl.
CPC ..... *E21B 43/122* (2013.01); *E21B 43/126* (2013.01); *E21B 43/128* (2013.01); *E21B 43/129* (2013.01)

(58) Field of Classification Search
CPC .... E21B 43/122; E21B 4/02; E21B 2021/005; E21B 2021/006; E21B 21/14;
(Continued)

(56) References Cited

U.S. PATENT DOCUMENTS 3,751,192 A * 8/1973 Boyd ..... E21B 43/128 318/432
5,488,993 A * 2/1996 Hershberger ..... E21B 43/122 166/372

(Continued)

FOREIGN PATENT DOCUMENTS

EP 0756065 A1 1/1997

*Primary Examiner* — Cathleen R Hutchins
*Assistant Examiner* — Jonathan Malikasim
(74) *Attorney, Agent, or Firm* — Harness, Dickey & Pierce, PLC

(57) ABSTRACT

A hydrocarbon production facility includes: a hydrocarbon well; a hydrocarbon production line including: in the well, a production tube, and on the surface, an evacuation tube from the production tube; on the surface, a source of pressurized gas; an injection line of pressurized gas in the hydrocarbon production line, linked to the source of pressurized gas; a pump for circulation of hydrocarbon from the well hydrocarbon circulation; a pneumatic motor for supplying power to the pump, fitted on the injection line of the pressurized gas and adapted to be rotated by expansion of the pressurized gas. A corresponding production method and an upgrade method of a facility are also disclosed.

13 Claims, 4 Drawing Sheets

(58) Field of Classification Search
CPC ..... E21B 21/16; E21B 41/0085; E21B 43/12; E21B 43/121; E21B 43/126; E21B 43/128
See application file for complete search history.

(56) References Cited

U.S. PATENT DOCUMENTS

| | | | | |
|---|---|---|---|---|
| 6,032,737 | A * | 3/2000 | Brady | E21B 43/385 166/265 |
| 6,293,341 | B1 | 9/2001 | Lemetayer | |
| 8,789,609 | B2 * | 7/2014 | Smith | E21B 43/129 166/372 |
| 9,091,157 | B2 | 7/2015 | Ndinemenu et al. | |
| 2005/0011649 | A1 | 1/2005 | Stewart et al. | |
| 2006/0000357 | A1 * | 1/2006 | Michael | B01D 53/04 95/273 |
| 2006/0081378 | A1 | 4/2006 | Howard et al. | |
| 2011/0308812 | A1 | 12/2011 | Bullen | |
| 2014/0205469 | A1 | 7/2014 | Lindsay | |

* cited by examiner

Fig.1
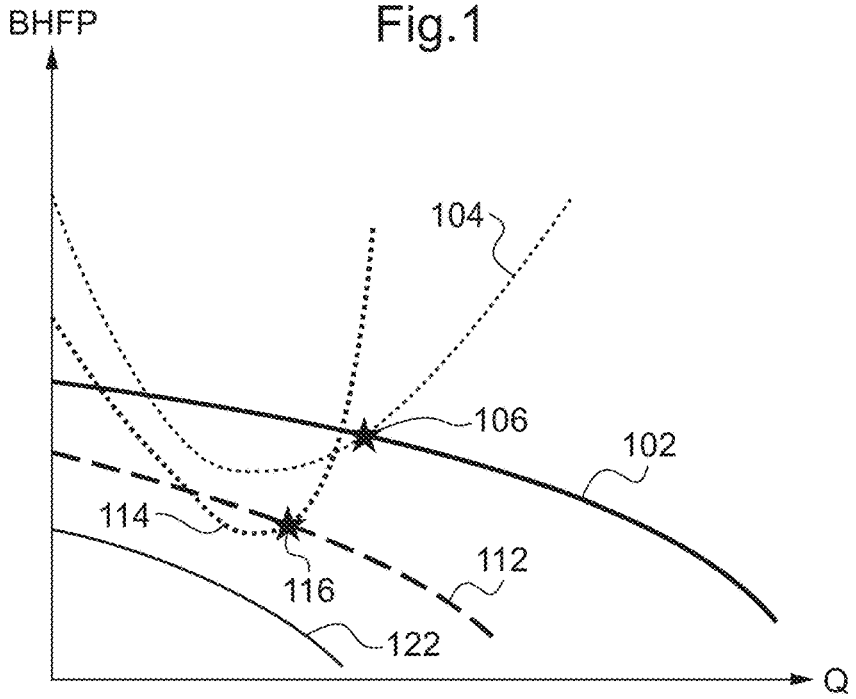
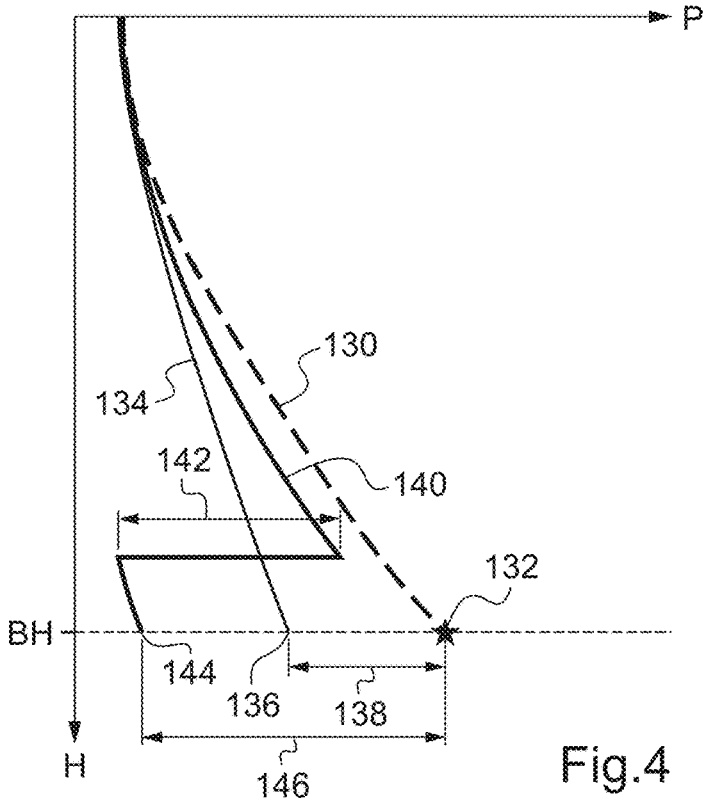
Fig.4

HYDROCARBON PRODUCTION FACILITY, PRODUCTION METHOD AND UPGRADE METHOD

CROSS-REFERENCE TO RELATED APPLICATIONS

This application is a National Phase Entry of International Patent Application No. PCT/EP2014/072006, filed on Oct. 14, 2014, which claims priority to French Patent Application Serial No. 13 59 993, filed on Oct. 14, 2013, both of which are incorporated by reference herein.

BACKGROUND AND SUMMARY

The present invention relates to a facility and a method for producing hydrocarbon. The present invention also relates to a method for upgrading a hydrocarbon production facility.

In the field of hydrocarbon production, it is known to use the injection of pressurized gas into a hydrocarbon production well to improve the production of this well. Documents EP 0 756 065 A1 and FR 2 783 557 A1, for example, describe the injection of gas for activation of the hydrocarbon production of a well. Gas injection reduces the hydrostatic pressure of the well to facilitate the extraction of hydrocarbons. However, such method known by activation using gas injection (method designated as well by "gas lift") may not allow to reduce sufficiently the hydrostatic pressure to operate the well in a satisfactory manner.

FIG. 1 shows a diagram of different characteristics of the productivity in relation with the fluid pressure in the well bottom hole and the flow rate, named Q. The fluid pressure of the well bottom hole is designated in FIG. 1 by the reference sign BHFP, abbreviation of "Bottom Hole Fluid Pressure". FIG. 1 shows three characteristics 102, 112 and 122, of different wells. These wells are different by their gradient of natural lift, as defined by the following equation:

$$Lg = \frac{BHP - THP}{H} * 10.2$$

wherein Lg is the gradient of the well natural lift;

BHP is the bottom hole pressure in bars (abbreviation of "Bottom Hole Pressure")

THP is the wellhead pressure in bars (abbreviation of "Tubing Hanger Pressure");

H is the vertical depth of the well in m.

The characteristics of curves 112 and 122 correspond thus to wells with an Lg lower than the well characteristic represented by the curve 102, Lg related to the well of the curve 122 being itself lower than the Lg related to the well of the curve 112.

Curves 104 and 114 of FIG. 1 correspond respectively to the performance of a gas lift called light and to the performance of a gas lift called heavy. The light gas lift has two operating points with the well of curve 102 whose point 106 allows a greater flow, Q, of well production. However, the light gas lift has no operating point with wells of lower Lg such as wells of curves 112 and 122. The low gas lift allows then the operation of wells with a Lg included between 0.6 and 1.0. The positioning of the heavy gas lift ensures then the operation of the well of curve 112 at an operating point 112 but does not allow to operate the well of curve 122 with which it has no operating point. The strong gas lift allows to operate wells with a Lg included between 0.3 and 0.5. In other words, the gas lift, even strong, is insufficient for operating the wells with a too low Lg.

There is therefore a need for a hydrocarbon production method and facility wherein activation by gas injection is insufficient to obtain a reduction of the hydrostatic pressure of the well allowing the operation of the well.

Therefore, the invention proposes a hydrocarbon production facility, comprising:

- a well of hydrocarbons;
- a hydrocarbon production line comprising:
  - in the well, a production tube, and
  - on the surface, an evacuation tube from the production tube;
- on the surface, a source of pressurized gas;
- an injection line of pressurized gas in the hydrocarbon production line, the injection line being connected to the source of pressurized gas;
- a pump for circulation of hydrocarbon from the well to the hydrocarbon production line;
- a pneumatic motor for supplying power to the pump, disposed on the injection line of the pressurized gas and adapted to be rotated by expansion of the pressurized gas.

Alternatively, the facility comprises a mechanical transmission shaft connecting the pneumatic motor to the pump. Alternatively, the pneumatic motor is an electric generator. Alternatively, the pump in the well is an electric submersible type or a progressive cavity type. Alternatively, the pump is disposed in the well bottom hole.

Alternatively, the injection line opens into the well bottom hole, preferably in the production tube of the hydrocarbon production line. Alternatively, the pneumatic motor is at the wellhead. Alternatively, the pneumatic motor is at the well bottom hole. Alternatively, the injection line opens into the evacuation tube of the production line, downstream of the circulation pump.

The invention also provides a method of operating a hydrocarbon production well activated by gas injection, comprising:

a) providing pressurized gas from a source of pressurized gas surface;

b) recovering energy by the expansion of pressurized gas under pressure using a pneumatic motor;

c) actuating a pump for circulation of hydrocarbon from the well using energy recovered in step b);

d) injecting expanded pressurized gas in a hydrocarbon production line.

Alternatively, pressurized gas is at a pressure higher than or equal to 70 bars prior to expansion. Alternatively, pressurized gas is expanded by the pneumatic motor at a pressure less than or equal to 30 bars.

The invention also concerns an upgrade method of a hydrocarbon production facility, the facility comprising:

- a well of hydrocarbons;
- a hydrocarbon production line comprising:
  - in the well, a production tube, and
  - on the surface, an evacuation tube from the production tube;
- on the surface, a source of pressurized gas;
- an injection line of pressurized gas in the hydrocarbon production line, the injection line being connected to the source of pressurized gas;

the method comprising:

positioning a pump for circulation of hydrocarbon from the well; and positioning, on the injection line of pressurized gas, a pneumatic motor for supplying power to the pump, adapted to be rotated by expansion of the pressurized gas.

BRIEF DESCRIPTION OF THE DRAWINGS

Other characteristics and advantages of the invention will appear after reading the following detailed description of the invention exemplary embodiments and with reference to the drawings showing:

FIG. 1, a diagram of different characteristics of productivity in relation with the bottom hole fluid pressure and the flow rate;

FIG. 4, a diagram of the course of the pressure according to the depth in a well for various well operation methods.

DETAILED DESCRIPTION

Figure 2:
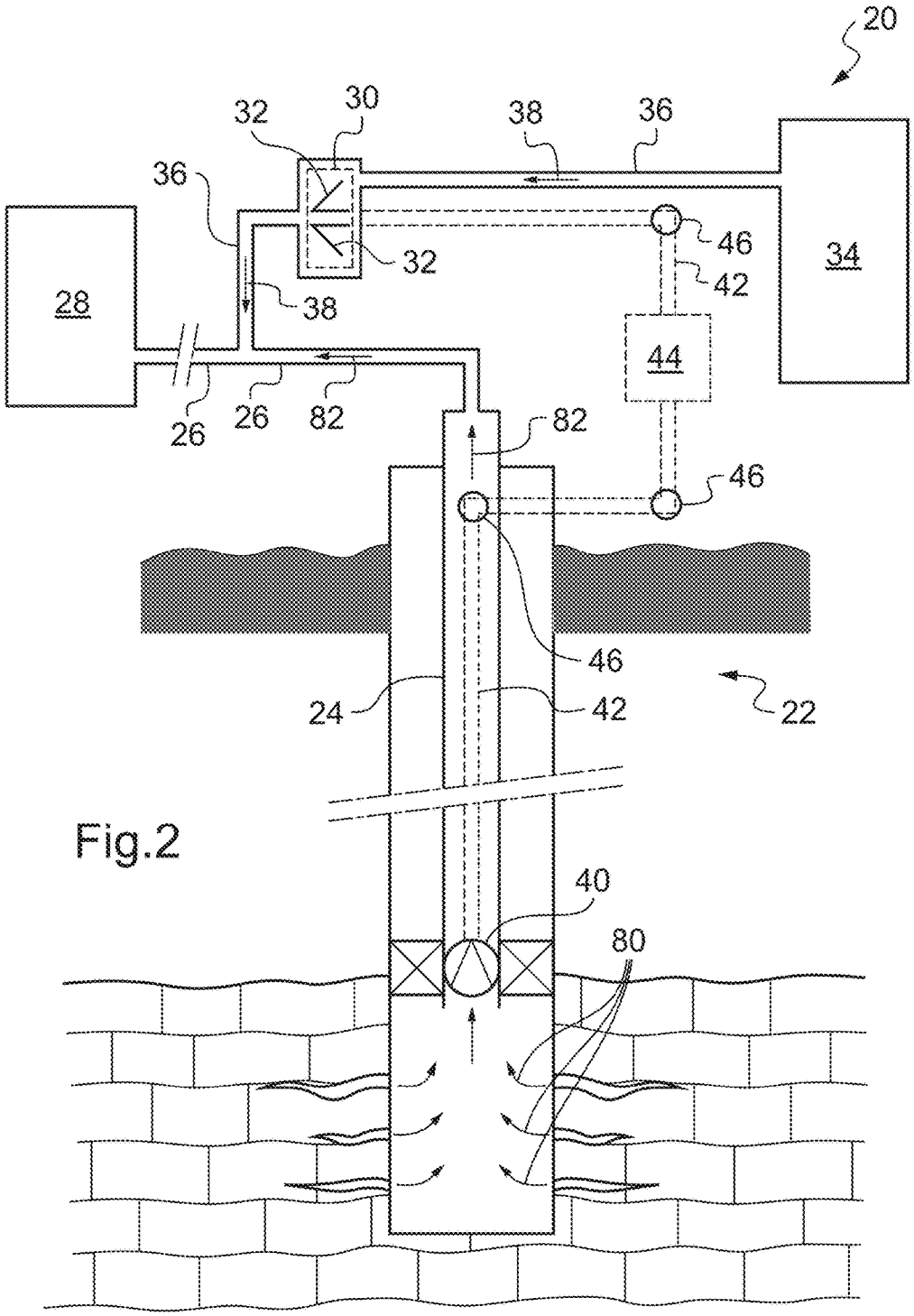
FIG. 2, a schematic sectional view of an embodiment of hydrocarbon production facility.

The invention describes a hydrocarbon production facility. With reference to FIG. 2, the hydrocarbon production facility 20 comprises a well 22 of hydrocarbons. To lift the hydrocarbons 80 from the well 22, the facility comprises a production line having a production tube 24 in the well 22 and an evacuation tube 26 on the surface from the production tube 24. The tube 26 on the surface allows for example the evacuation to a reservoir 28 of the hydrocarbon product storage. Prior to storage, the tube 26 on the surface may also be used to evacuate the products 82, lifted by the production tube 24 and comprising hydrocarbons 80, to product 82 separation devices (not shown). The product 82 separation devices may in particular separate water, gas and oil.

The facility 20 comprises a pump 40 for circulation of hydrocarbon from the well 22 in the production line to facilitate the lift of hydrocarbons 80 by the production tube 24. This pump 40 may be disposed at the well bottom hole 22 and is designated later in this document by the term "bottom hole pump". Such a bottom hole pump (40) ensures or increases hydrocarbon production by the well 22, particularly where activation by injection of pressurized gas is insufficient to obtain a reduction of hydrostatic pressure, or a back pressure, from the well 22 to operate the well 22. In an alternative, not shown, the pump 40 may be disposed on the surface of the evacuation tube 26. Such an arrangement of the pump 40 allows as well to increase the production by lowering the back pressure of the well 22 while facilitating the maintenance of the pump 40 which is then more accessible.

In the embodiment illustrated in FIG. 2, the pump 40 is driven by a turbine 30. The positioning of the turbine 30 is embodied on one hand in the figures using dashed lines and on the other hand by the schematic representation of blades 32 of the turbine 30. This turbine 30 is disposed in a line 36 of pressurized gas 38 to be rotated by expansion of the pressurized gas 38. In other words, the turbine 30 supplies the pump 40 with energy, this energy is derived from the expansion of the pressurized gas 38. The turbine 30 may be replaced by any other type of pneumatic motor, a pneumatic motor converting energy stored in compressed gas into mechanical energy. The turbine may be replaced by any other pneumatic motor of hydrodynamic type or a pneumatic motor of volumetric type, the pneumatic motor includes then an expansion chamber which volume is variable. The proposed pneumatic motor of volumetric type may thus correspond to a circumferential piston pneumatic motor. To prevent racing, the pneumatic motor, such as the turbine 30, may be provided with a diversion, otherwise designated by the term "by-pass". To control automatic opening of the by-pass, the proposed facility may include a speed controller integrated in the pneumatic motor. In particular, in the absence of speed controller, the speed of the turbine or the pneumatic motor may be transmitted on the surface in the form of a sound through the production tube 24 of the well 22. The transmitted sound may have the impact frequency at each rotation of the pneumatic motor to be a characteristic of the pneumatic motor rotation speed.

The kinetic energy transmission from the turbine 30 to the pump may be performed using a rotated shaft 42 (shown by dashed lines). This mechanical transmission shaft 42 connects the turbine 30 to the pump 40. As illustrated in FIG. 2, the mechanical connection between the turbine 30 and the pump 40 comprises a reducer 44 for modulating the rotational speed of the shaft 42 causing the actuation of the pump 40. The shaft 42 is then split into two portions, a portion connecting the turbine 30 to the reducer 44 and another portion connecting the reducer 44 to the pump 40. Such a reducer may be of magnetic type for obtaining a high conversion ratio. Similarly, the mechanical connection between the turbine 30 and the pump 40 may also include a clutch (not shown). Moreover, to facilitate the kinetic energy transmission from the location of the turbine 30 to the bottom hole pump 40 without being constrained by a straight line trajectory, the shaft 42 may include various joints 46.

In the embodiment illustrated in FIG. 2, the transmission of energy recovered by the turbine 30 to the pump 40 is then carried out without additional energy conversion. In one alternative embodiment not illustrated, the turbine 30 may be an electric generator. Energy transmitted from the turbine 30 to the pump 40 is then electric enabling to overcome mechanical constraints associated with the use of the mechanical transmission shaft 42 in particular when the well 22 trajectory is too aggressive. According to this alternative embodiment, the bottom hole pump 40 may be of electric submersible type (a pump type also designated by "Electric Submersible Pump", abbreviated as "ESP"). In all embodiments described above, the bottom hole pump 40 may be of progressive cavity type (a pump type also designated by the "Progressive Cavity Pump" abbreviated as "PCP"). The use of a progressive cavity pump stabilizes the well 22 by enabling direct control of the well 22 flow rate. In comparison to the power electric transmission, the mechanical transmission of the pneumatic motor, as the turbine 30, to the pump 40 reduces the presence of electric equipment at the well bottom hole. In such case of power mechanical transmission, the lifetime of the facility is improved due to the independence of the proposed facility to such electric equipment at the well bottom hole 22.

The pressurized gas 38 driving the turbine 30 from a pressurized gas source 34, on the surface relative to the well 22, the source is illustrated herein as a reservoir. However, pressurized gas sources 34 are generally available on the surface in known hydrocarbon production facilities. In fact, the presence of pressurized gas sources on the surface is particularly required when facilities are activated by injection of pressurized gas into the production line (production method also referred to as "gas lift").

Eventually, such an energy source being already present on known hydrocarbon production facilities, the proposed facility 20 enables the drive of the bottom hole pump 40 facilitating the production of hydrocarbons and this, in the absence of additional power distribution network. By not using the additional power distribution network, the proposed facility 20 is particularly advantageous when the production facility 20 is remote from any power generation site location or inhabited place.

A hydrocarbon production upgrade method is particularly provided. Upgrading a hydrocarbon production facility corresponds to the adaptation of existing facilities to the solution described above. The devices already present before upgrading the facility are for example the well 22, the production line, the pressurized gas source 34 and the pressurized gas 38 injection line 36 in the production line. Such an upgrade method adds the bottom hole pump 40, or the pump on the surface, and the turbine 30 or other pneumatic motor to these devices already present in the facility to be upgraded. In other words, the method comprises the deployment of the pump 40 in the well 22 or on the surface and the deployment of the pump power supply in the injection line 36 of the turbine 30. The upgrade method can of course comprise the deployment of any other device described herein and in particular the deployment of one, several or all devices interacting with the pump 40 and/or with the turbine 30, such as for example the mechanical transmission shaft 42 and the reducer 44.

Furthermore, this invention provides as well a hydrocarbon production method incorporating the operation principles of the proposed hydrocarbon production facility 20. Such method comprises initially the provision of pressurized gas 38 from the pressurized gas source 34, on the surface. This step allows the recovery of energy already available in production facilities by gas lift. The source 34 may for example provide the gas 38 before expansion at a pressure greater than or equal to 70 bars or about 65 bars.

This energy is then recovered by the expansion of the pressurized gas 38 using the turbine 30 or any other pneumatic motor. The pressurized gas 38 may be expanded by the turbine 30 to a pressure less than or equal to 30 bars. This recovered energy in kinetic form is forwarded in this form or in another form, such as electric energy, to the pump 40 in the well 22 for its actuation. The bottom hole pump 40 contributes to the lift on the surface of hydrocarbons 80 from the production well though the hydrocarbon production line to the reservoir 28.

The gas 38 after expansion may be injected into the hydrocarbon production line. The pressurized gas 38 after expansion has an injection pressure lower than if the pressurized gas 38 is injected into the production line without pre-expansion or excessive pressure such as 70 or 65 bars.

During a ramp-up phase of the well operation, at the start of the operation of the well 22, the lower injection pressure prevents an excessive instantaneous flowrate (phenomenon also designated by "steam break through"). Such a phenomenon occurs in effect when the pressure drop provided at the well bottom hole by the gas lift is too important and affects the well productivity. The lower injection pressure also prevents racing in case of instantaneous flashing (phenomenon also referred to by "steam flashing").

During a phase of well stimulation (a phase designated also by "boosting"), implemented when the well production 22 begins to decline, the system reduces the sub-cool without risk, difference between the hydrocarbon temperature and the evaporation temperature of said hydrocarbons at the same pressure. The sub-cool may then be lower without any risk of racing, i.e. without risk of vaporization. By limiting the sub-cool, hydrocarbons to be produced are warmer, less viscous and therefore easier to extract.

The remainder of this document exposes in particular the differences between the embodiments of hydrocarbon production facilities 20 operating according to the preceding method. According to the embodiment of the production facility specifically illustrated in FIG. 2, the gas 38 injection line 36 opens into the surface in the evacuation tube 26 of the production line. The expanded pressurized gas 38 is thus injected into the surface portion of the production line called "flow line". The injection of expanded pressurized gas 38 in the surface portion of the production line can achieve a reduction of the hydrostatic pressure of the production line even when the pressure after expansion is low.

Figure 3:
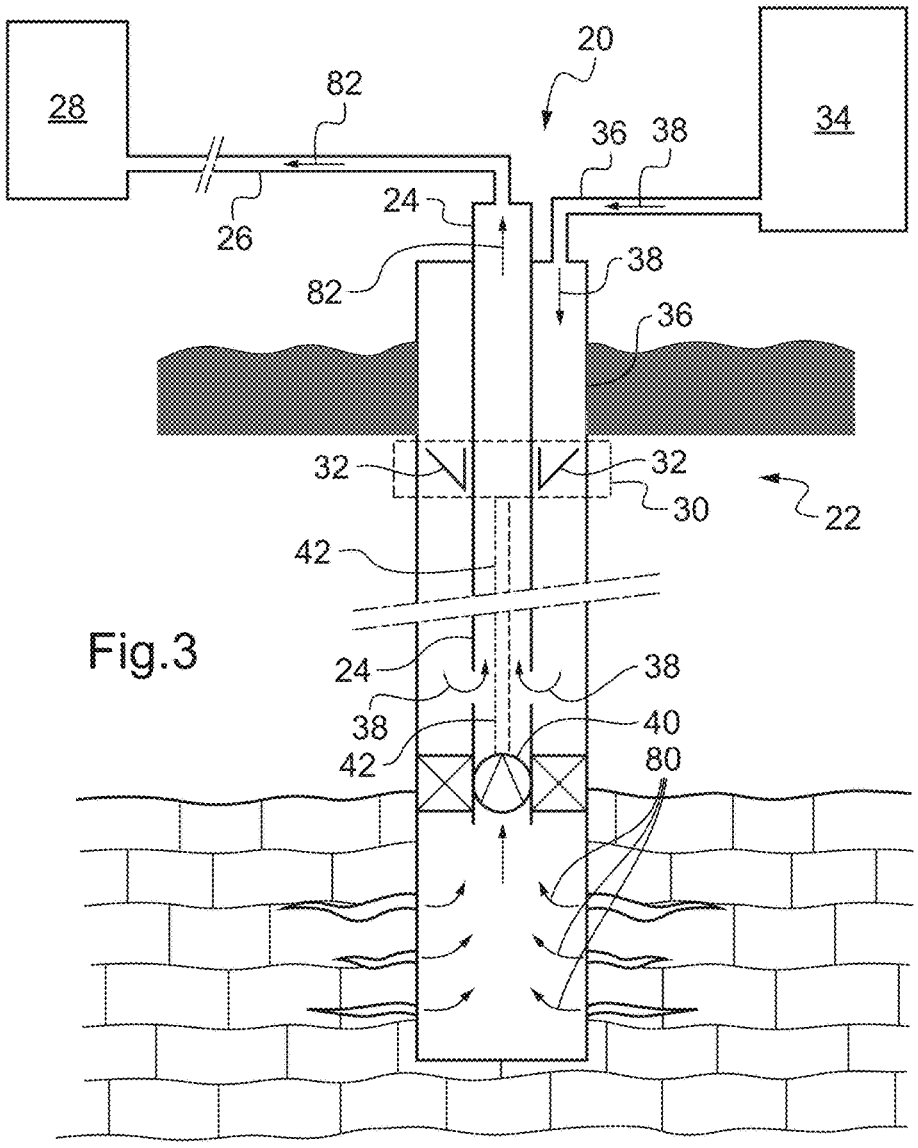
FIG. 3, a schematic sectional view of an embodiment with gas lift of hydrocarbon production facility.

According to another embodiment illustrated in FIG. 3, the pressurized gas 38 is provided to be injected in the production line at the production tube 24, to activate the production of hydrocarbons 80. As for the injection line 36 portion disposed in the well 22, the injection line 36 is in the form of a ring around the production tube 24. The gas 38 is expanded by the turbine 30 before being injected into the well 22 production line. Similarly to the embodiment illustrated in FIG. 2, in FIG. 3 the production of hydrocarbons is facilitated by the bottom hole pump 40 on one hand and by gas injection on another hand. However, the gas injection in the well 22 production line as illustrated in FIG. 3 corresponds to a gas lift technique, i.e. activation by gas injection. In particular, in the embodiment illustrated in FIG. 3, the injection of expanded gas 38 is carried out at the "well bottom hole" above the location of the bottom hole pump 40, directly into the production line at the production tube 24. In all cases, embodiments of FIG. 2 or FIG. 3, the gas injection is performed downstream of the pump in the production line.

The expression "well bottom hole" is used herein as to characterize close positioning of geological layers forming the hydrocarbon bearing reservoir operated by the well 22. This expression is used in opposition with the expressions "wellhead" and "on the surface". The expression "on the surface" characterizes herein the positioning at ground level, above ground or immediately below ground. A device disposed on the surface may thus correspond to a device buried at a negligible depth with respect to the depth of the well. The expression "wellhead" characterizes herein the positioning "on the surface", directly above the well, i.e. vertically above the well. Thus, the distance between a "wellhead" positioning and a "bottom hole" positioning is substantially equal to the length of the well 22 trajectory. The mixed lines modelling the suspended view of the well 22 in figures separate on one hand the wellhead and the surface, above the mixed lines, from the well 22 bottom hole on another hand below the mixed lines.

In the embodiment illustrated in FIG. 3, the turbine 30 is disposed in the wellhead of the well 22. For this embodiment as for the embodiment illustrated in FIG. 2, the turbine 30 arrangement on the surface prevents that the expansion of pressurized gas 38 at the turbine 30 does not cool the hydrocarbons 80 at the well 22 bottom hole. The cooling of the hydrocarbons 80 by gas may for example result in the formation of deposition, such as the formation of paraffin deposition for the paraffinic hydrocarbons, otherwise designated by the paraffinic raw expression. The embodiments illustrated in FIGS. 2 and 3 have the advantage of facilitating risk management of deposition which is limited at the injection of expanded gas 38 in the production line, either on the surface of the well or in the wellhead of the well, respectively.

Furthermore, the embodiment illustrated in FIG. 3 can optionally have more diameter. Such an embodiment is then particularly preferred for the production of hydrocarbons present in the form of "heavy oil". For such application to the production of "heavy oil", the bottom hole pump 40 is preferably of PCP type. The use of the pump 40 of PCP type for the production of "heavy oil" enables a stabilization of activation by gas injection and a better control of the flow, particularly, at the beginning of the production after the injection of pressurized gas 38 in the production line. Moreover, to further facilitate the production of hydrocarbons of "heavy oil" type, in addition to gas lift and bottom hole pump 40, the pressurized gas 38 may be heated after being expanded by the turbine 30.

The positioning of the turbine 30 on the surface also contributes to facilitating the architecture of the facility. In fact, in the mechanical transmission variants of the energy from the turbine 30 to the pump 40, the reducer 44 may be very bulky, especially where the reducer 44 is of magnetic type. The arrangement of the turbine 30 on the surface allows then the arrangement of the reducer 44 on the surface between the turbine 30 and the pump 40, the surface being less subject to space constraints than the well 22 bottom hole.

The proposed facility, especially as illustrated in FIG. 3, allows lowering the pressure in the well 22 according to the diagram of FIG. 4. FIG. 4 shows a diagram of the pressure course, P, according to vertical depth, H, in the well 22. The point BH, an abbreviation of the expression "Bottom Hole", corresponds to the vertical depth at the well bottom hole. The facility illustrated in FIG. 3 allows the pressure to follow the curve 140 having a decreased pressure 142 at the depth to which the pump 40 is disposed. This decrease in pressure 142 provides a low pressure of the bottom hole at the point 144. This low pressure at the point 144 is to be compared to the pressure obtained at the point 132 which is the hydrostatic pressure of hydrocarbons at the well bottom hole. Point 132 is the point of the curve of hydrostatic pressure in dashed lines 130 in depth at the well bottom hole. In other words, the curve 130 corresponds to the pressure course in the naturally-occurring well, i.e. in the absence of particular devices in the well to facilitate the production of the well. The bottom hole pressure obtained using the proposed facility corresponds, relatively to the point 132 of the hydrostatic pressure at the well 22 bottom hole, to a pressure drop 146 (also known as the "draw down") promoting the extraction of the hydrocarbons from the well 22. The use of one portion of pressurized gas energy to actuate the bottom hole pump 40 and another portion of the pressurized gas energy used in gas lift allows a double acting extraction of the well 22 hydrocarbons from a single source.

Upon placement of a conventional gas lift in the well 22, i.e. using the same pressurized gas 38 but without expansion before injection, the pressure based upon the depth follows the curve in thin lines 134 to reach a bottom hole pressure at point 136. This bottom hole 22 pressure allows a pressure drop 138 less than the pressure drop 146 permitted by the proposed facility. Double acting extraction from a single source enables then a higher production of the well 22 in comparison to the use of the total energy of the pressurized gas in gas lift. The injection of pressurized gas after expansion corresponds in fact to the use of gas lift in its effective domain, as for pressures in the range of or less than 30 bars, the excess energy is used as mechanical energy for driving the pump 40.

Moreover, the higher production may be achieved with levels of pressurized gas 38 pressure in the range of 70 bars or 65 bars. The use of pressure levels in the range of 70 bars or 65 bars limits the risk of erosion of the facility and increases the number of used technologies in comparison to the use of higher pressures in gas lift to obtain an efficiency comparable to the proposed double acting extraction.

Figure 5:
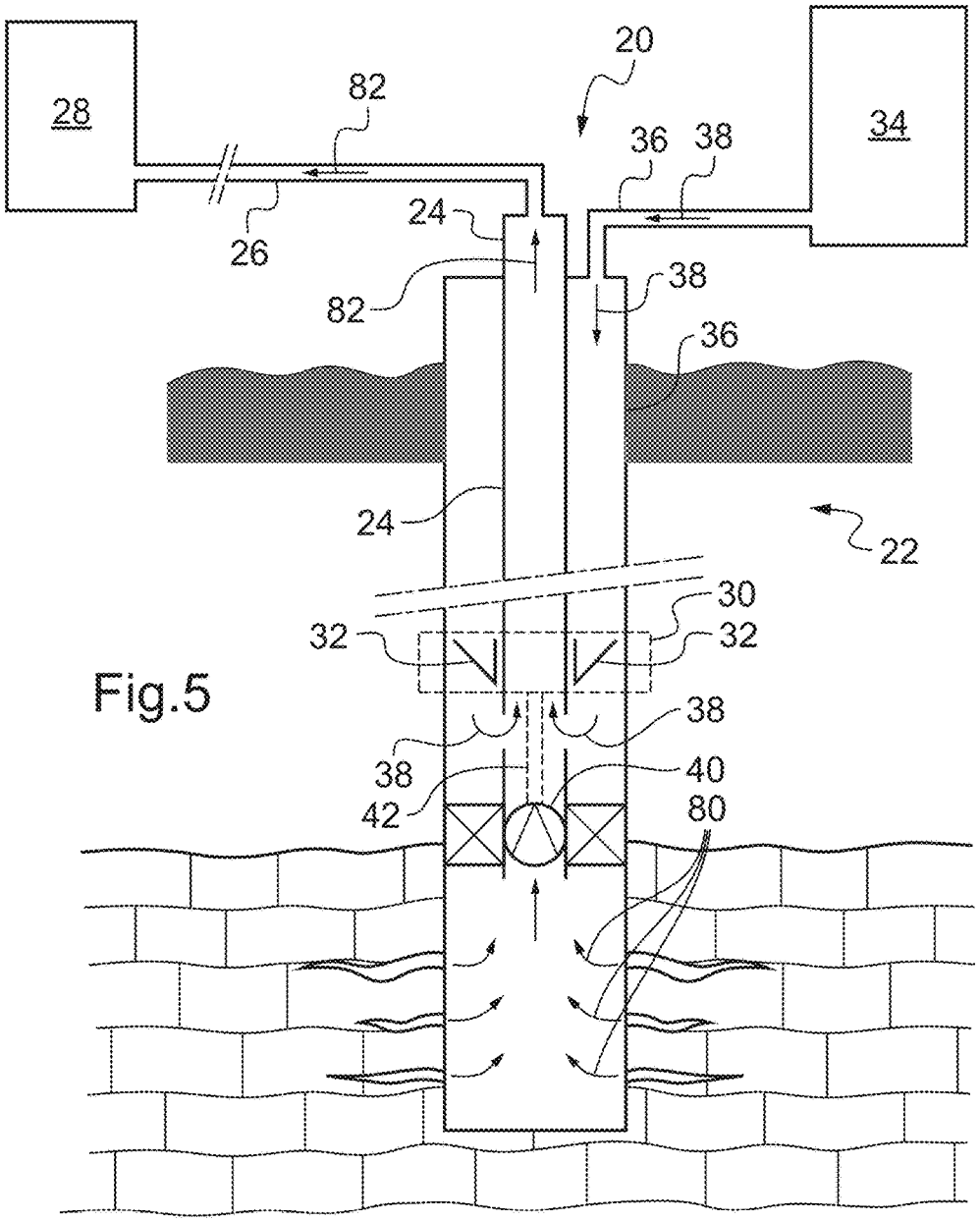
FIG. 5, a schematic sectional view of another embodiment with gas lift of hydrocarbon production facility.

Alternatively to the positioning of the turbine 30 on the surface, FIG. 5 shows an embodiment of the facility where the turbine 30 is disposed at the well bottom hole. This embodiment is particularly advantageous when hydrocarbons 80 to be produced are very hot. The heat of hydrocarbons 80 to be produced limits the influence on producing hydrocarbon 80 cooling by the injection of expanded pressurized gas 38. In such case of producing hydrocarbons at a high temperature, in the proposed facility, the pump 40 may be of a high speed roto-dynamic type, preferably to a more expensive electric submersible pump high temperature (abbreviated as "ESP-HT"). The arrangement of the turbine 30 at the well bottom hole may also be considered when it is provided to preheat the pressurized gas 38 in the annular portion of the injection line 36 in order to limit the cooling of hydrocarbons to be produced. In all cases, due to the positioning of the turbine at the well bottom hole, the pressurized gas before expansion is warmer than in the aforementioned embodiments with reference to FIGS. 2 and 3.

The embodiment illustrated in FIG. 5 with the pneumatic motor at the well 22 bottom hole, illustrated as a turbine 30, is preferred than the embodiment illustrated in FIG. 3 with the well 22 wellhead motor for the said phase of stimulating the well 22 when hydrocarbons are heavy oils. In general, the embodiment illustrated in FIG. 5 is also preferred for the well 22 of standard crudes. Conversely, the embodiment illustrated in FIG. 3 is preferred for the aforementioned well 22 operation ramp-up when hydrocarbons are heavy oils.

Of course, the present invention is not limited to the examples and the embodiments described and represented, but is capable of many variants accessible to the person skilled in the art. In particular, the injection of expanded pressurized gas can be carried out for the same hydrocarbon production facility in both the production tube 24 at the well bottom hole and in the discharge tube 26 on the surface. Such a variant corresponds to the combination of embodiments illustrated in FIG. 2 and FIG. 3.

Furthermore, in addition to the bottom hole pump 40 and the optional gas lift, the injection line of pressurized gas may include one or more boosters (not shown) to increase the pressure of the pressurized gas upstream of the turbine. This pressure increase allowed by the boosters allows more energy to the turbine and/or more energy after the expansion carried out on the turbine for activating the well by the injection of expanded gas. This pressure increase by the boosters allows ultimately an even greater improvement of the well production.

The invention claimed is:

1. A hydrocarbon production facility, comprising:

a well of hydrocarbons;

a hydrocarbon production line comprising:

(a) in the well, a production tube, and (b) on the surface, an evacuation tube from the production tube;

on the surface, a source of pressurized gas;

a pump for circulation of hydrocarbon from the well to the hydrocarbon production line;

an injection line of pressurized gas in the hydrocarbon production line, the injection line being connected to the source of pressurized gas and opening into a surface outside the well in the evacuation tube of the hydrocarbon production line, downstream of the pump for circulation;

a pneumatic motor located at the surface for supplying power to the pump for circulation, disposed on the injection line of the pressurized gas and adapted to be rotated by expansion of the pressurized gas; and a mechanical transmission shaft connecting the pneumatic motor to the pump.

2. The hydrocarbon production facility according to claim 1, where the pneumatic motor is an electric generator.

3. The hydrocarbon production facility according to claim 1, wherein the pump in the well is one of: an electric submersible pump or a progressive cavity pump.

4. The hydrocarbon production facility according to claim 1, wherein the pump is disposed in a well bottom hole.

5. The hydrocarbon production facility according to claim 1, wherein the facility is configured to be activated by injection of pressurized gas into the production line.

6. The hydrocarbon production facility according to claims 1, wherein the facility is configured to be remote from any power generation site location or inhabited place.

7. A method of operating a hydrocarbon production well activated by gas injection, using a hydrocarbon production facility and comprising the well, the hydrocarbon facility comprising:

a well of hydrocarbons;

a hydrocarbon production line comprising:

in the well, a production tube, and on the surface, an evacuation tube from the production tube;

on the surface, a source of pressurized gas;

a pump for circulation of hydrocarbon from the well to the hydrocarbon production line;

an injection line of pressurized gas in the hydrocarbon production line, the injection line being connected to the source of pressurized gas and opening into a surface outside the well in the evacuation tube of the hydrocarbon production line, downstream of the pump for circulation;

a pneumatic motor located at the surface for supplying power to the pump for circulation, disposed on the injection line of the pressurized gas and adapted to be rotated by expansion of the pressurized gas;

a mechanical transmission shaft connecting the pneumatic motor to the pump;

the method comprising:

a) providing the pressurized gas from the pressurized gas source on the surface of the facility;

b) recovering energy by the expansion of the pressurized gas using the facility pneumatic motor;

c) actuating the pump for circulation of hydrocarbon from the well using the energy recovered in step b); and d) injecting an expanded pressurized gas in the hydrocarbon production line of the facility.

8. A method according to claim 7, wherein the pressurized gas is at a pressure higher than or equal to 70 bars prior to the expansion.

9. A method according to claim 7, wherein the pressurized gas is expanded by the pneumatic motor to a pressure less than or equal to 30 bars.

10. The method according to claim 7, where the pneumatic motor is an electric generator.

11. The method according to claim 7, wherein the pump in the well is one of: an electric submersible pump or a progressive cavity pump.

12. The method according to claim 7, wherein the pump is disposed in a well bottom hole.

13. A method of operating a hydrocarbon production well activated by gas injection, using a hydrocarbon production facility comprising:

a well of hydrocarbons;

a hydrocarbon production line comprising:

in the well, a production tube, and on the surface, an evacuation tube from the production tube;

on the surface, a source of pressurized gas;

a pump for circulation of hydrocarbon from the well to the hydrocarbon production line;

an injection line of pressurized gas in the hydrocarbon production line, the injection line being connected to the source of pressurized gas, and opening into a surface outside the well in the evacuation tube of the hydrocarbon production line, downstream of the pump for circulation;

a pneumatic motor located at the surface for supplying power to the pump for circulation, disposed on the injection line of the pressurized gas and adapted to be rotated by expansion of the pressurized gas;

a mechanical transmission shaft connecting the pneumatic motor to the pump;

the method comprising the upgrade of the facility by:

positioning the pump for circulation of hydrocarbon from the well; and positioning, on the injection line of the pressurized gas, the pneumatic motor for supplying power to the pump, adapted to be rotated by expansion of the pressurized gas.

* * * * *